US008281943B2

(12) United States Patent
Suman et al.

(10) Patent No.: US 8,281,943 B2
(45) Date of Patent: Oct. 9, 2012

(54) SHELVING SYSTEM

(75) Inventors: Michael Suman, Caledonia, MI (US); Lynn Smith, Holland, MI (US)

(73) Assignee: Angleworks, LLC, Holland, MI (US)

( * ) Notice: Subject to any disclaimer, the term of this patent is extended or adjusted under 35 U.S.C. 154(b) by 162 days.

(21) Appl. No.: 12/868,068

(22) Filed: Aug. 25, 2010

(65) Prior Publication Data

US 2011/0068071 A1 Mar. 24, 2011

Related U.S. Application Data

(60) Provisional application No. 61/244,245, filed on Sep. 21, 2009.

(51) Int. Cl.
*A47F 5/08* (2006.01)

(52) U.S. Cl. ..... 211/150; 211/90.02

(58) Field of Classification Search ..... 211/134, 211/90.02, 150, 193, 175, 90.01, 90.04, 87.01; 248/289.11, 122.1, 242; 108/5, 9, 115, 92, 108/99

See application file for complete search history.

(56) References Cited

U.S. PATENT DOCUMENTS

| | | | | | |
|---|---|---|---|---|---|
| 749,670 | A | * | 1/1904 | Gardner | 248/242 |
| 1,371,256 | A | | 3/1921 | Michaelson | |
| 1,554,137 | A | | 9/1925 | Slifkin | |
| 1,607,887 | A | * | 11/1926 | Fowler | 248/201 |
| 1,826,055 | A | | 10/1931 | Cornwall | |
| 2,767,950 | A | | 10/1956 | Bellon et al. | |
| 2,812,220 | A | | 11/1957 | King | |
| 2,988,232 | A | | 6/1961 | Koett | |
| 3,186,559 | A | | 6/1965 | Glowa | |
| 3,213,965 | A | | 10/1965 | Fedoryk | |
| 3,247,811 | A | | 4/1966 | Bauder | |
| 3,322,077 | A | * | 5/1967 | Kovacik | 108/163 |
| 3,485,382 | A | | 12/1969 | Larson | |
| 3,830,375 | A | | 8/1974 | Larson | |
| 3,954,068 | A | | 5/1976 | Roberts et al. | |
| 4,492,169 | A | | 1/1985 | Ware et al. | |
| 4,531,646 | A | * | 7/1985 | Howard | 211/150 |
| 4,605,131 | A | * | 8/1986 | Debus et al. | 211/90.02 |
| 4,625,873 | A | * | 12/1986 | Hayashi | 211/119 |
| 4,771,898 | A | * | 9/1988 | Howard et al. | 211/59.2 |
| 5,503,279 | A | * | 4/1996 | Wentworth | 211/175 |
| 5,553,934 | A | * | 9/1996 | Wells et al. | 312/128 |
| 5,603,267 | A | | 2/1997 | Soper | |
| 5,730,068 | A | * | 3/1998 | Rioux, Jr. | 108/99 |
| 5,746,331 | A | * | 5/1998 | Kurtis | 211/149 |
| 5,816,419 | A | * | 10/1998 | Lamson | 211/150 |
| 5,988,410 | A | * | 11/1999 | Mandle | 211/133.1 |
| RE36,638 | E | | 4/2000 | Herman | |

(Continued)

*Primary Examiner* — Jennifer E. Novosad
(74) *Attorney, Agent, or Firm* — Price Heneveld LLP

(57) ABSTRACT

A shelving system includes a frame with vertical frame members and cross braces, a shelf with three-sided perimeter groove and under-shelf groove, a wire perimeter shelf support engaging the perimeter groove and vertical frame members, and a wire under-shelf support constructed to engage the under-shelf groove and the vertical legs in a stable arrangement. The assembled shelving system does not require tools or separate fasteners for assembly, and assembly is quick, easy and intuitive, yet allows for flexibility, customization, and adaptation for different uses and desired aesthetics. A variety of very different shelving systems can be constructed by purchasing different frames, shelves, and accessories. The system can be leaned against a wall at an angle, or fastened vertically against a wall. Shelves are angularly adjustable, height adjustable, and replaceable. A pair of systems angled against each other form a free standing arrangement, and can support a header panel therebetween.

22 Claims, 15 Drawing Sheets

U.S. PATENT DOCUMENTS 6,158,600 A * 12/2000 Ferrucci et al. ..... 211/90.02
6,164,465 A 12/2000 Schroeder
6,357,609 B1 * 3/2002 Van Noord et al. ..... 211/90.02
6,679,189 B1 * 1/2004 Henningfeld ..... 108/106
D521,276 S 5/2006 Lenger
7,198,160 B2 * 4/2007 Ernst et al. ..... 211/150
7,249,680 B2 * 7/2007 Wang ..... 211/37
8,109,579 B2 * 2/2012 English et al. ..... 312/137
2004/0118792 A1 6/2004 Herring
2008/0250988 A1 10/2008 Merey
2009/0026161 A1 1/2009 Scriba et al.

* cited by examiner

SHELVING SYSTEM

This application claim benefit under 35 U.S.C. §119(e) of Ser. No. 61/244,245, filed Sep. 21, 2009, entitled SHELVING SYSTEM, the entire contents of which are incorporated herein by reference.

BACKGROUND

The present invention relates to shelving systems, and more particularly to a shelving system including interconnectable components configured for quick and fastenerless interconnection, but also configured for adjustability, aesthetics, flexibility of use, and functionality.

People need shelving for many different reasons, but often struggle to find affordable shelving that meets their particular needs. Further, many shelving systems lack adjustability, aesthetics, flexibility of use, and functionality, thus limiting the consumer and/or forcing the consumer to make "permanent" choices. Still further, many shelving systems require significant assembly, which consumers may not want to bother with and/or are not good at. Often the assembly is not intuitive and requires detailed instructions and tools (along with mechanical ability to read and follow instructions). Many consumers do not have tools or mechanical aptitude to assemble shelves, depending on the shelf's construction, especially for wall-mounted shelves.

Stores require display shelves for displaying product in an aesthetic and pleasing manner. The capital investment in store shelving is significant, yet it can be critical to a store's success, especially for point-of-purchase stores where the tendency of consumers to buy is greatly affected by the display aesthetics. Store shelves are desired, that are intuitive to assemble, and that include a minimum of components, while also providing adjustability, aesthetics, flexibility of use, wide/multi-purpose functionality, and reasonable cost.

SUMMARY OF THE PRESENT INVENTION

In one aspect of the present invention, a shelving system includes at least two spaced frame members, a shelf positioned between the frame members and defining opposing side grooves extending fore-aft of the shelf, and a shelf support slidably engaging the side grooves in a first direction parallel the side grooves for assembly. The shelf support includes end sections engaging the frame members in a second direction not parallel the first direction, with the end sections being held in engagement by a width of the shelf. The system further includes an under-shelf support adapted to support the shelf in a use position.

In a narrower aspect, the system includes multiple shelves, shelf supports, and under-shelf supports, but no separate fasteners for connecting the same.

In another narrower aspect, the shelf support is flexible so that the end sections can be manipulated into holes in the frame members when the shelf is not present, but so that the end sections are held in the holes when the shelf is present.

In another aspect of the present invention, a shelving system includes a shelf adapted for positioning between the frame members and defining opposing side grooves, and a shelf support slidably engaging the side grooves in a first direction parallel the side grooves for assembly and including end sections engaging the frame members in a second direction not parallel the first direction, the end sections being adapted to be held in engagement with spaced frame members by a width of the shelf.

In another aspect of the present invention, a shelving system includes a shelf defining opposing parallel side grooves and a front groove, a U-shaped bent-wire shelf support slidably engaging the side grooves in a first direction parallel the side grooves for assembly, and a bent-wire under-shelf support engaging a bottom groove on the shelf.

In another aspect of the present invention, a method of assembly comprises steps of: providing a frame with spaced frame members, a shelf with a perimeter groove and bottom retainer, a shelf support configured to engage the perimeter groove and the frame members, and an under-shelf support adapted to engage the retainer and the frame members. The method includes placing the shelf support between the frame members with ends of the shelf support engaging the frame members without the use of separate fasteners; and assembling the shelf onto the shelf support including sliding the shelf so that the perimeter groove slidingly engages the shelf support and so that, when assembled, the shelf holds the ends of the perimeter support in the frame members. The method further includes stabilizing the shelf in a selected orientation by assembling the under-shelf support between the retainer and the frame members without the use of separate fasteners.

The present appearance is also believed to be novel, ornamental, and unobvious, and hence patentable.

An object of the present invention is to provide a stable and secure shelving system that is intuitive to assemble, and that can be assembled without the need for tools and without the use of separate fasteners.

An object of the present invention is to allow a user to mix and match all components for a desired aesthetic appearance and to match a desired décor.

An object of the present invention is to provide a shelving system that is configured for quick and easy interconnection, but also configured for adjustability, aesthetics, flexibility of use, and functionality.

An object of the present invention is to provide a shelving system well suited for point of purchase display of product at stores and distribution sites.

These and other aspects, objects, and features of the present invention will be understood and appreciated by those skilled in the art upon studying the following specification, claims, and appended drawings.

BRIEF DESCRIPTION OF DRAWINGS

FIG. 10 is also showing a rotatable locking tab.

DETAILED DESCRIPTION OF PREFERRED EMBODIMENTS

Figure 10:
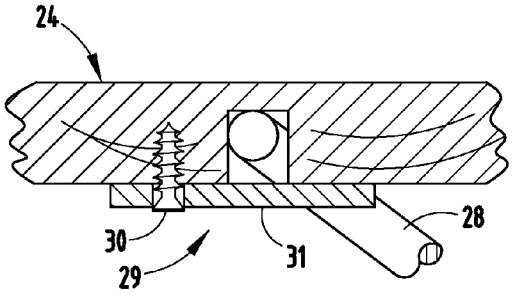
FIG. 10 is a fragmentary side cross sectional view along line X-X in FIG. 9.

The present shelving system 20 (FIGS. 1-2) includes a frame 21 with vertical frame members 22 (also called "legs") and cross braces 23 (also called "transverse frame members"), three shelves 24 each with three-sided perimeter groove 25 and undercut groove 26 on their bottom surface (also called a "bottom retainer"), a bent-wire perimeter shelf support 27 for each shelf adapted to engage the groove 25 and with ends adapted to engage holes in the vertical frame members 22, and a bent wire under-shelf support 28 (also called a "bail" or "angled support") adapted to engage the undercut groove 26 and holes in the vertical frame members 22. The illustrated under-shelf support 28 is held in place by gravity. However, a catch 29 (see FIG. 10) can optionally be used to positively retain the angled support 28 in the groove 26, or it can instead be frictionally retained. Alternatively, the groove can be cut at an angle into the shelf bottom to further assist in secure engagement with the angled support. The assembled shelving system 20 does not require tools or separate fasteners, and assembly is quick and easy, yet it allows for substantial flexibility and adjustability. Shelves can be easily repositioned and/or positioned horizontally or tilted at different angles. Further, by purchasing different frames and shelves, a variety of very different shelving systems arrangements and aesthetics can be constructed.

Figure 1:
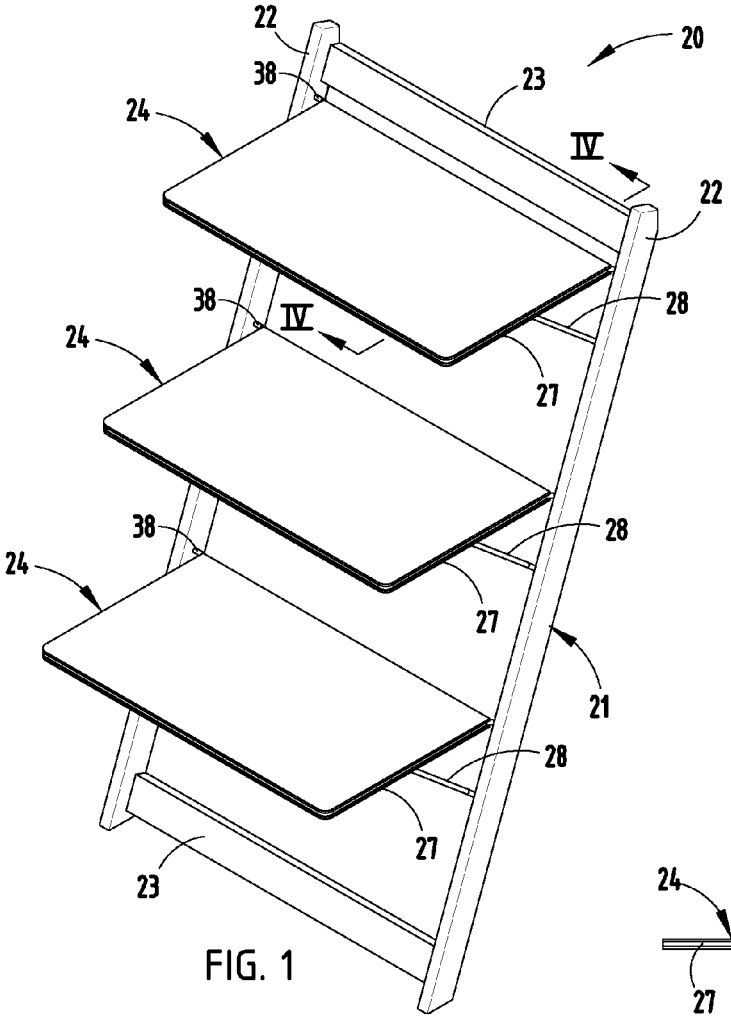
FIGS. 1, 1A, -2 are perspective, side and exploded-perspective views of a shelving system embodying the present invention.
Figure 3:
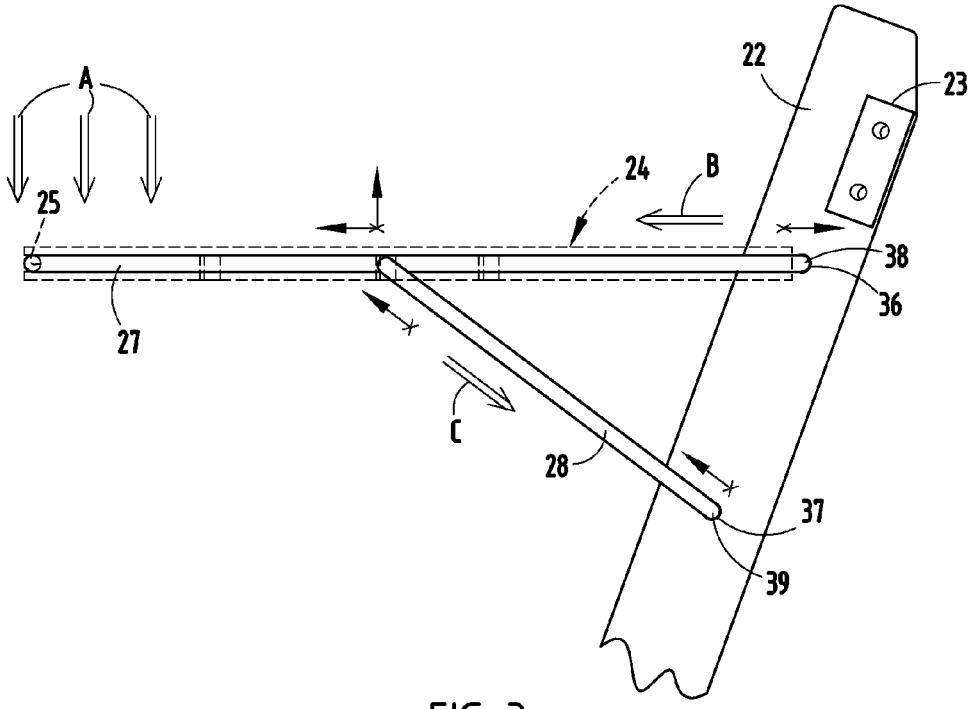
FIG. 3 is a schematic side view similar to FIG. 1A but showing force vectors in double-line arrows and reactive vectors in single-line arrows.
Figure 4:
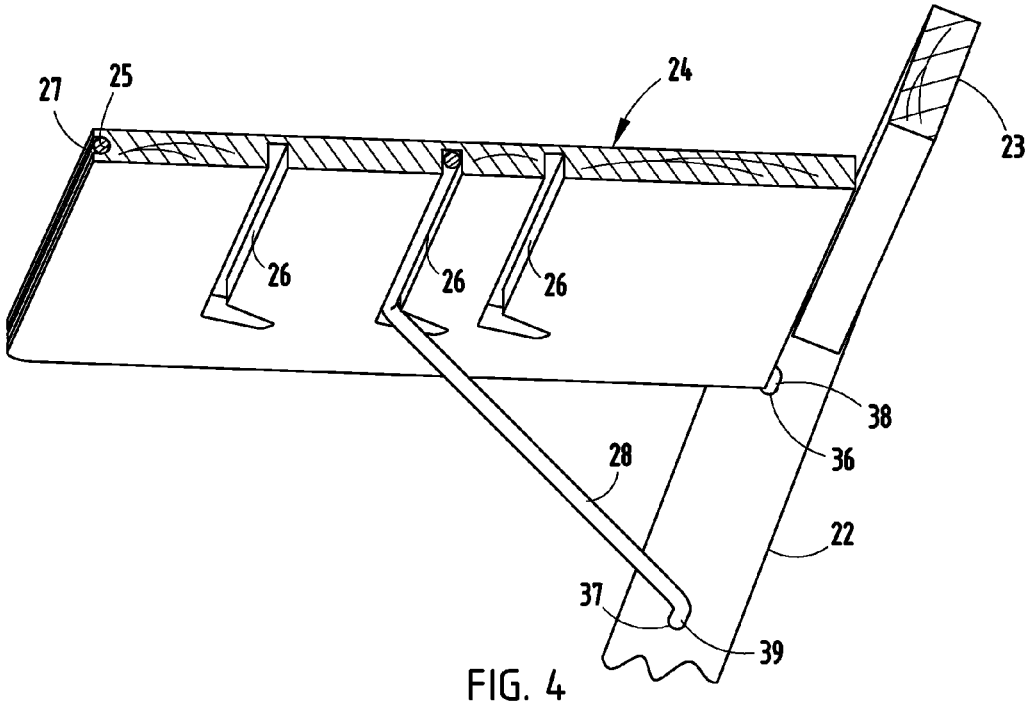
FIG. 4 is an enlarged cross sectional view showing a bottom of the shelf of FIG. 1.

FIG. 3 is a schematic side view similar to FIG. 1 but showing a direction of loading forces on an assembly shelving system 20. When there is a load A on the shelf 24 (i.e., an object setting on the shelf), it transmits a compression load (see double lined arrows) through the shelf 24 into the angled support 28 in direction C to the frame 21. The combined forces of A and C on the frame 21 create a vector force in the direction B which is resisted by the perimeter support 27. The combination of forces cause the angled support 28 to engage the undercut groove 26 of the shelf 24 with increased force when increased weight is placed on the shelf. Thus, the greater a weight of the object on the shelf 24, a greater the retention of the angled support 28 in the shelf 24. The retention of the angled support 28 in the undercut groove 26 of the shelf 24 can also be made more positive by adding the catch 29 (FIG. 10), with includes a pre-assembled retainer screw/stud pivot 30 and a locking finger 31 for placement over a center of the angled support 28. It is also contemplated that the undercut groove 26 can be sized to frictionally engage the angled support 28 for a more positive retention, or alternatively, a steel snap-in clip can also be placed in the undercut groove 26 for frictionally engaging the angled support 28. Alternatively, a rubber frictional coating can be applied to the groove or bent-wire support. A steel clip would also have the advantage of providing a more durable structure, such as when the shelf 24 is made of wood, plastic, a composite, or the like.

Advantageously, the above-described shelving system 20 can be assembled with no tools or separate fasteners. Also, assembly is relatively intuitive, even to a novice assembler. Also, when multiple grooves are placed in a bottom of the shelf 24, the shelf can be set at different selectable angles by engaging the under-shelf angled support 28 into the selected groove. This facilitates alternative uses. For example, horizontal and/or different angled shelf positions can be selected for particular needs or improved display in a point-of-purchase shelf system when the system is leaned against a wall or abutted flat against a wall, such as for providing a flat or tilted storage of shoes, display of tools in a garage, display of spices in a pantry, storage of clothing articles in home or commercial applications, display of magazines, plants, books, and the like in indoor and outdoor applications, in both commercial and domestic locations.

It is contemplated that the present design also allows the shelf and shelf's top surface to be made of different materials and to provide different functions. For example, peg board can be used and, when hung vertical or at an angle, the peg board can hold hooks for retail applications or for item storage in a garage or closet. It is noted that the frame does not require the user to drill into a wall or to mount its supports. Nonetheless, one option is to secure the frame vertically against a wall, such as by using mounting brackets screwed to the wall (see FIGS. 22-24). Further, the present shelving system is very portable, and when not in use, can fold flat for compact storage (see FIG. 29) such as behind a door, in a closet, under a bed, or in a compartment in an RV when used outside (such as when camping).

Figure 5:
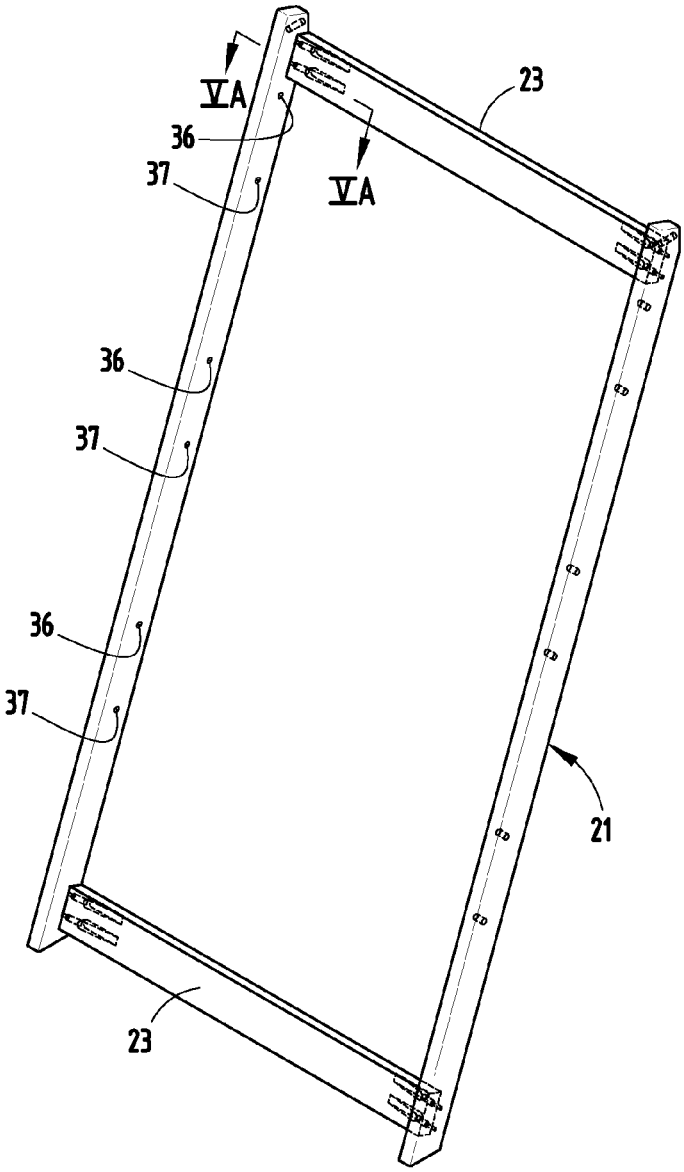
FIGS. 5-6 are perspective and side views of the frame of FIG. 1.
Figure 5A:
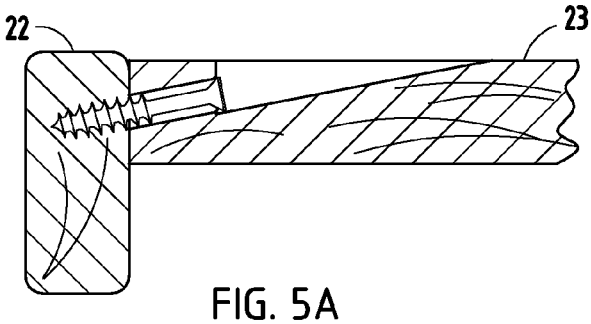
FIG. 5A is a cross section along line VA-VA in FIG. 5.
Figure 6:
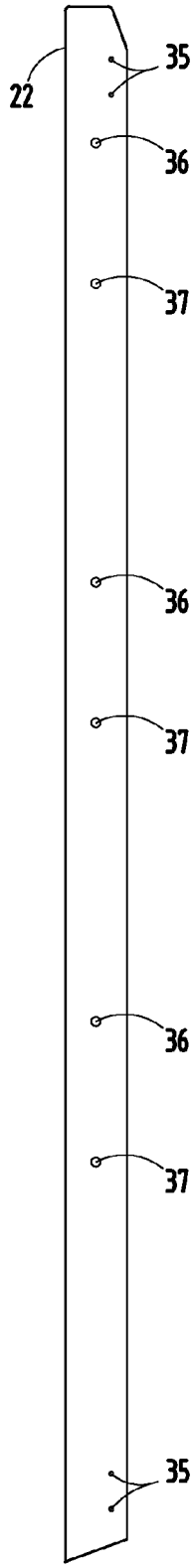
Figure 7:
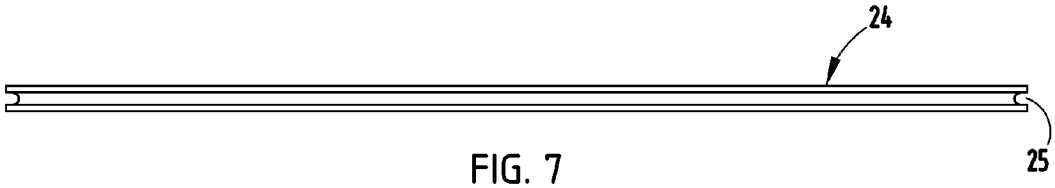
FIGS. 7-9 are end, side, and bottom views of the shelf of FIG. 1.
Figure 8:
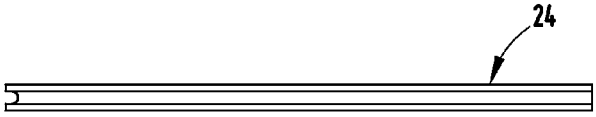
Figure 9:
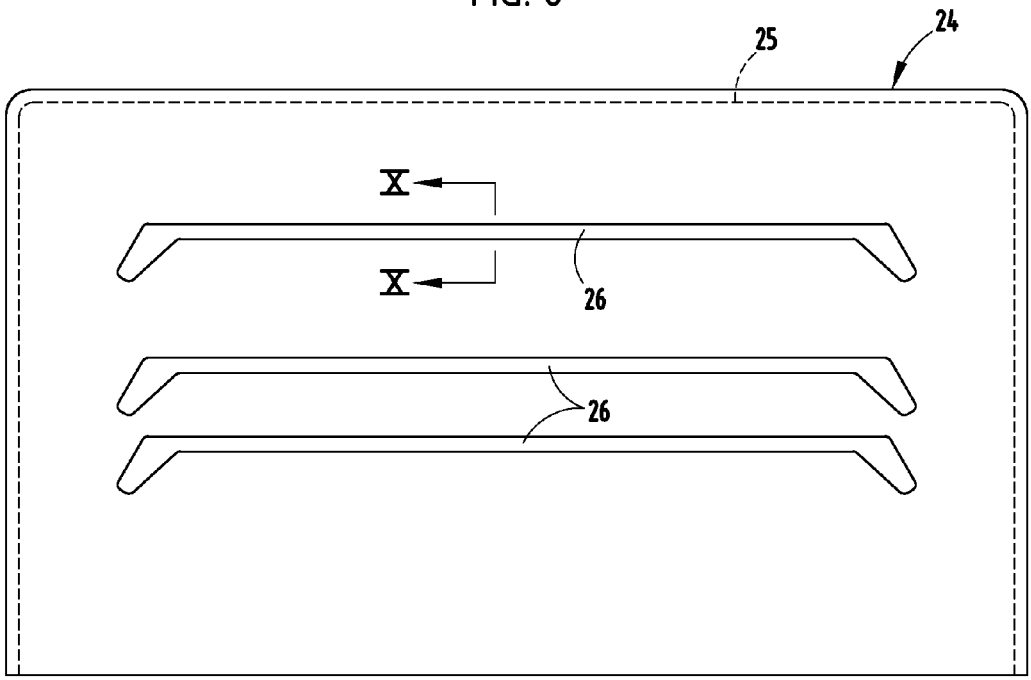
Figure 11:
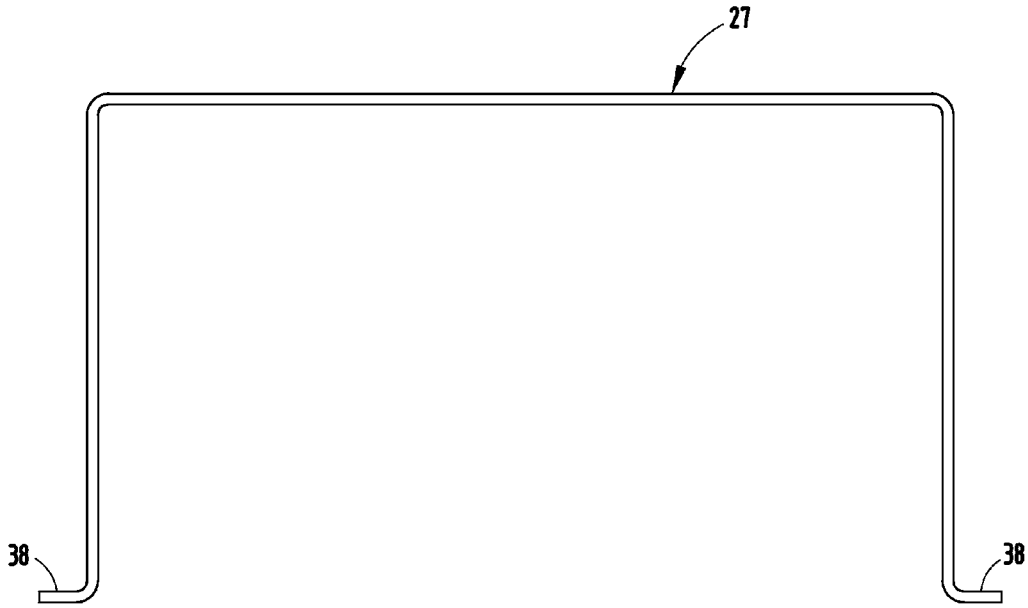
FIGS. 11-12 are plan views of a perimeter wire support and an angled under-shelf wire support ("bail") of FIG. 1, respectively.
Figure 12:
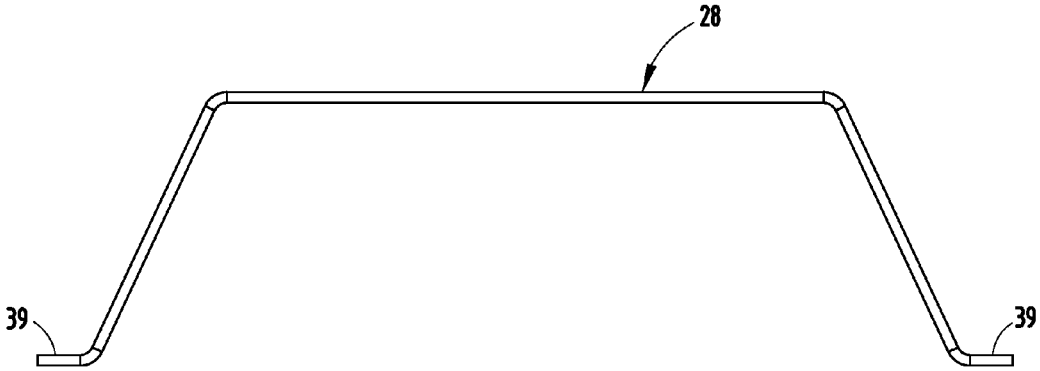

FIGS. 5, 5A-6 are perspective and side views of the shelf frame 21, including the vertical frame members 22 and cross braces 23. The frame members 22 are sized in length and cross section as needed for a particular use. The vertical frame members 22 and/or cross braces 23 can include holes 35 (see FIGS. 5 and 5A) for receiving screws to attach them together as illustrated, or they can be inter-connected in various other ways known in the art, such as by brackets or adhesion. It is contemplated that the cross braces 23 are also sized in length and cross section as needed, and can be secured by various means. As illustrated, the cross braces 23 are wood pieces of about 1"–2" pieces (or ¾"×1½", or alternatively can be dowels), and the frame members 22 are wood posts of about 2"×1" (¾"×1½", or the like) with the cross braces 23 assembled by screw-attachment (or friction fit and/or adhesive). A clip can be inserted into the holes 34 and 35 if needed for added stability, torsional strength, and retention strength. Multiple sets of holes 36 and 37 (FIG. 6) are drilled into an inboard side of the frame members 22 for receiving outer ends 38 and 39 (FIGS. 11-12) of the perimeter and angled supports 27 and 28. By positioning the holes 36 and 37 at coordinated locations (and potentially placing extra holes 37), the shelf 24 can be positioned horizontally at different heights or at a different angle(s) on the frame 21.

As illustrated, each set of holes 36 and 37 are positioned a spaced locations, such as 5-6" apart, and each set is positioned slightly more than 12" apart. The illustrated frame members 22 are positioned about 22" apart, and are about 43" long. A bottom and top of each frame member 22 is cut at about 20 degrees, so that the frame 21 will lean against a supporting building wall at about 20 degrees, with a flat surface area at the top end engaging the wall and also a flat surface at the bottom end engaging the floor (see FIG. 26A), the angle cut also facilitates a free standing arrangement (see FIG. 15 and FIGS. 20-21). A self-adhering frictional material can be placed on the flat surface of each frame member 22 that engages the floor or building wall for increased stability and reduced tendency to slip outward, or alternatively an adjustable foot (not shown) can be threaded into a bottom of each frame member 22, such as to allow adjustability in the event that a floor surface is not horizontal and even.

The illustrated shelf 24 (FIGS. 7-10) is a wood or wood-composition panel of about 20¼" wd×11½" dp×½" thick. (However, it could be made of other materials, such as plastic, composite, glass, metal, etc.) The shelf 24 includes the perimeter groove 25 which extends around three sides of the shelf and which is semicircular in cross section (i.e. to match a shape of the wire in the supports 27). The groove 25 is adapted to stably receive and engage the wire-rod perimeter shelf support 27 on three sides (i.e. the opposing sides and front edge) of the shelf 24. As illustrated, the perimeter support 27 is made from about ¼" diameter wire (or other wire diameter), with the wire fitting snugly into the groove 25 generally flush with or protruding slightly from an edge of the shelf 24. Notably, the perimeter support 27 is a bent wire U-shaped component that slidably receives the shelf 24 from a back side in a manner securely engaging the shelf without the use of separate fasteners.

To assemble a shelf 24 to the frame 21, the shelf support 27 is flexed slightly and the outer ends 38 of the perimeter support 27 is manipulated into holes in the frame members 22 of the frame 21. The shelf 24 is slipped into the perimeter support 27 from a back side of the frame 21, which effectively positively traps the outer ends 38 in the holes in the frame members 22 and also traps the perimeter support 27 in the perimeter groove 25 of the shelf 24. Then, the outer ends 39 of the angled support 28 are placed in selected holes in the frame 21, and a center of the angled support 28 is placed into the undercut groove 26. A catch 29 (if used) (FIG. 10) is then rotated to positively securely retain the angled support 28 on a bottom of the shelf 24.

The perimeter support 27 (FIG. 11) is U shaped, and includes three linear sections for engaging mating portions of the perimeter groove 25, and includes outwardly-facing ends 38 as discussed above. The angled support 28 (FIG. 12) is also generally U shaped, and includes a linear center section, angled side sections, and outer ends 39, as discussed above.

Figure 1A:
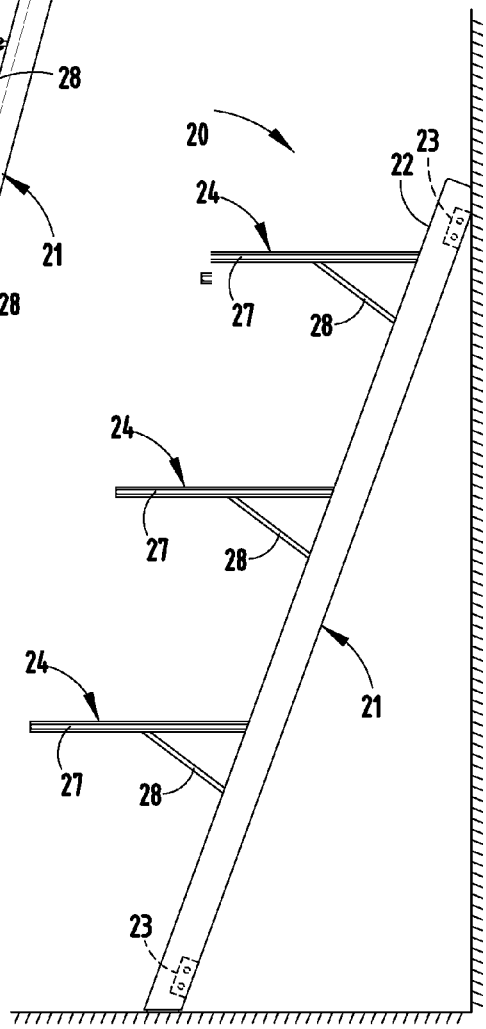
Figure 13:
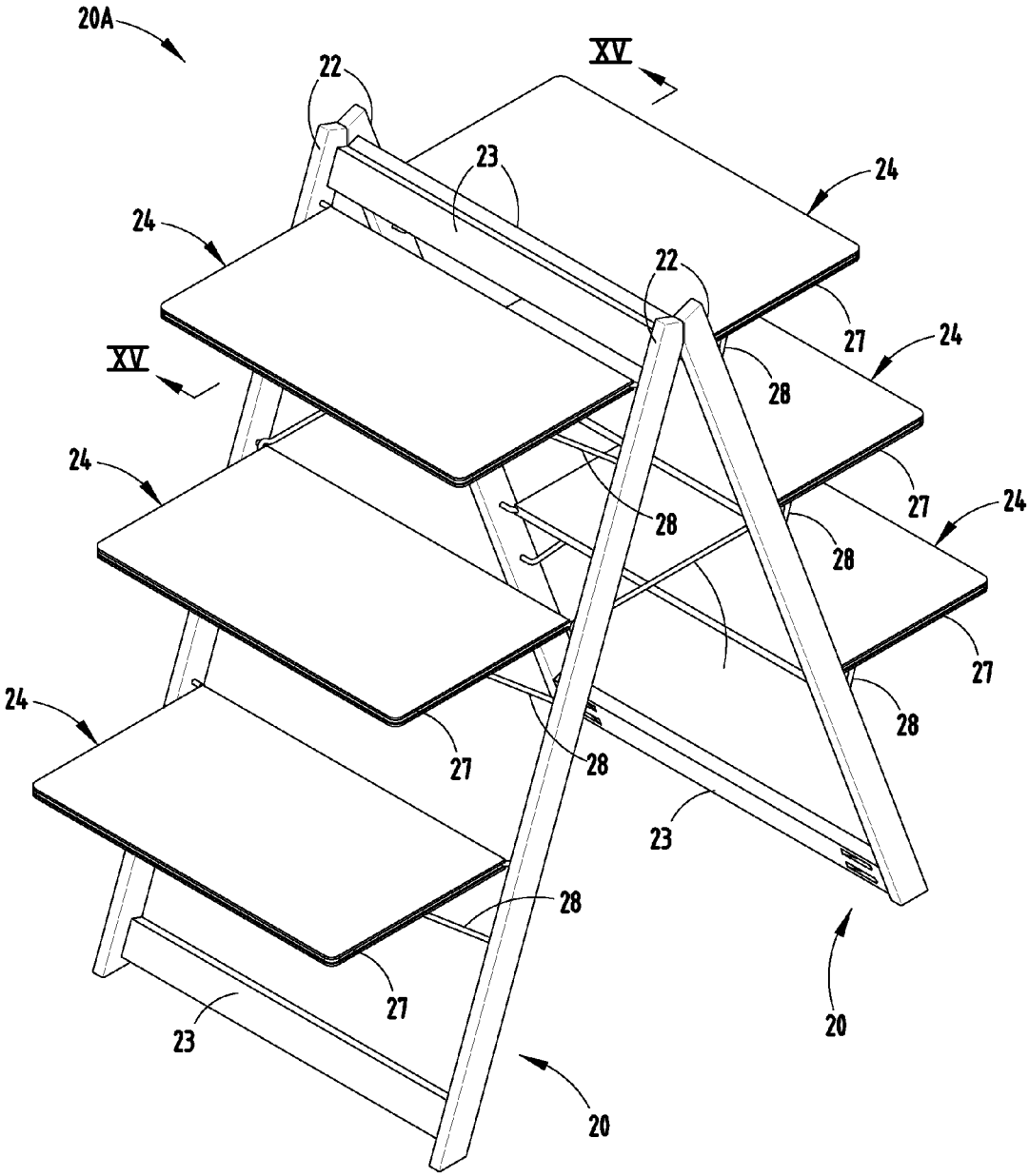
FIGS. 13-15 are perspective, exploded perspective, and side views of a second embodiment comprising a free-standing shelving system incorporating components from FIG. 1.
Figure 15:
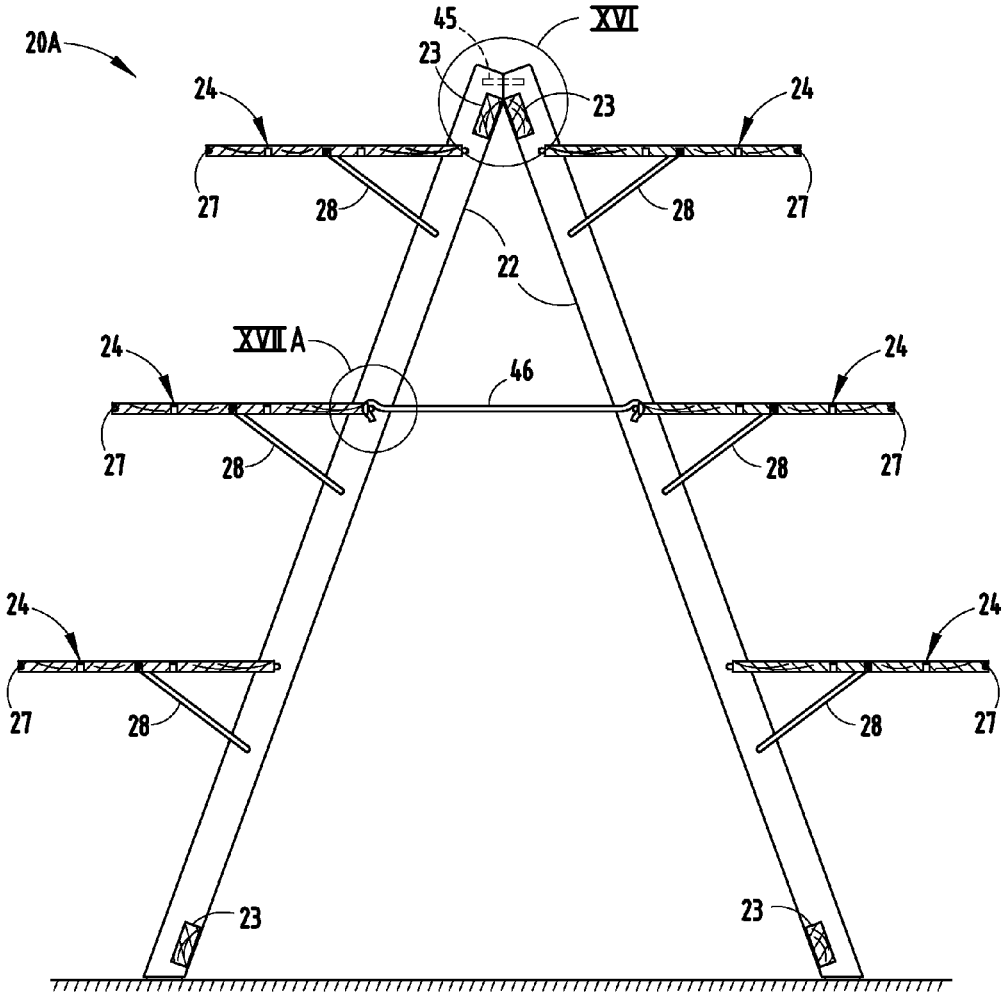
Figure 19:
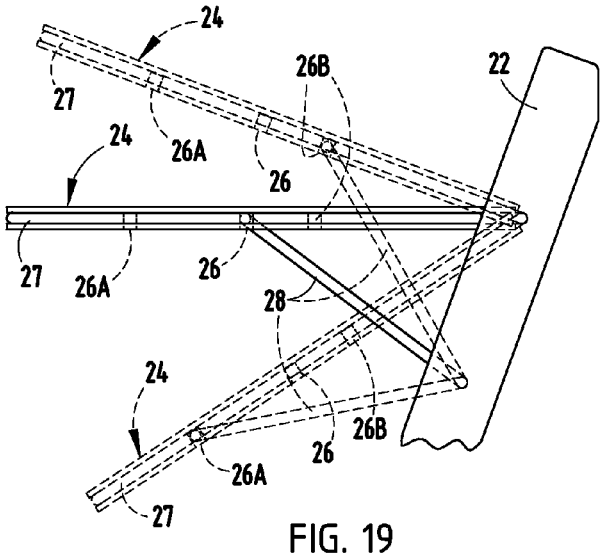
FIG. 19 is a fragmentary side view of FIG. 15 showing three positions of a given top shelf.
Figure 26:
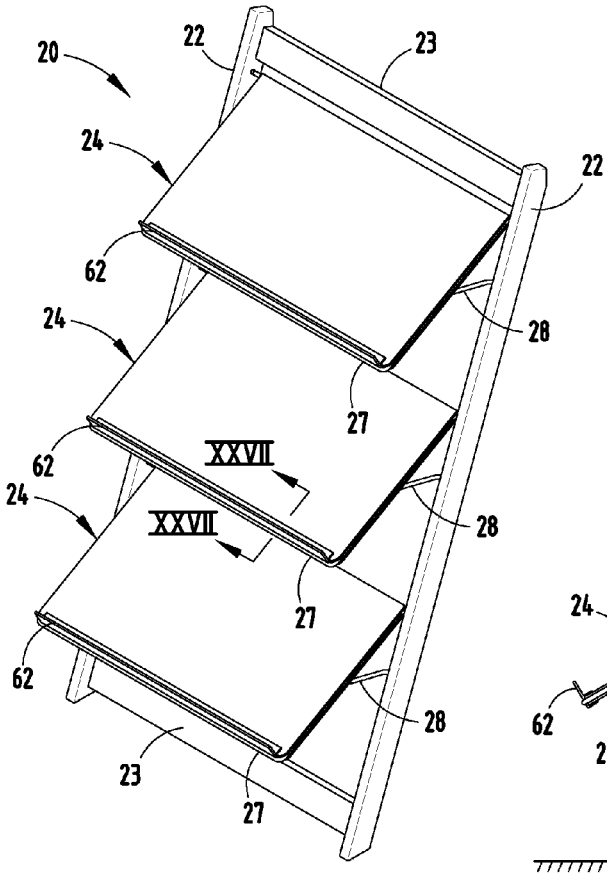
FIGS. 26 and 26A are perspective and side views of a lean-against-wall shelf system including shelf ledges attached to the shelves.
Figure 26A:
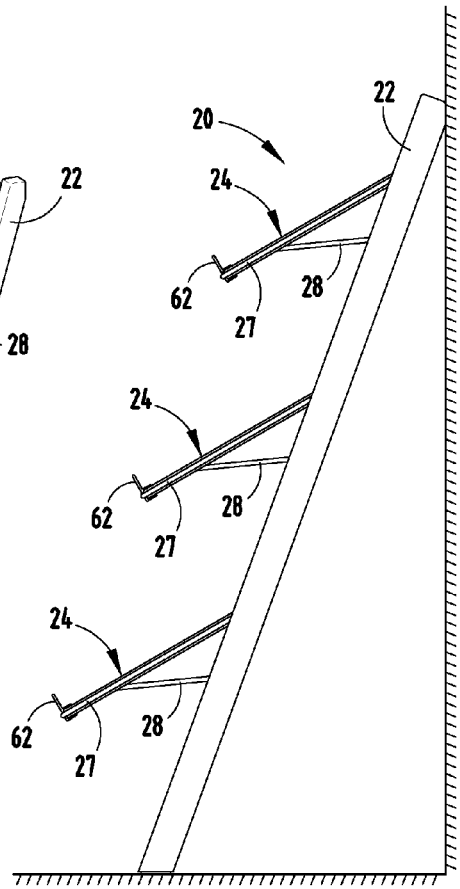

FIGS. 1, 19, and 26 show that by providing multiple sets of holes 36 and 37, a plurality of shelves 24 can be placed at various levels and angles. In one form (FIG. 1A), the present system is leaned against a supporting vertical structure in an angled self-supporting free condition. In another form (FIGS. 22, 24), the present frame 21 is attached to a vertical wall in a vertical orientation. It is contemplated that the frame 21 could include rearwardly-extending angled cantilevered feet so that a "single-sided" system (see FIG. 1) could be self-supporting and free standing. It is also contemplated that it could include an easel-like rearwardly-angled tripod-forming struts to be free standing. As illustrated in FIGS. 13 and 15, the system includes two identical subassemblies 20 abuttingly leaned against each other to form a tripod arrangement (see discussion below). Further, it is contemplated that the present system can be made to be various heights, widths, depths, materials, and leaned at different angles and be supported on different surfaces. The system can be readily adapted for different uses as will be apparent from the above discussion and following discussion. It is contemplated that the shelf system can incorporate utilities if desired, such as wires for power and data communication.

Figure 2:
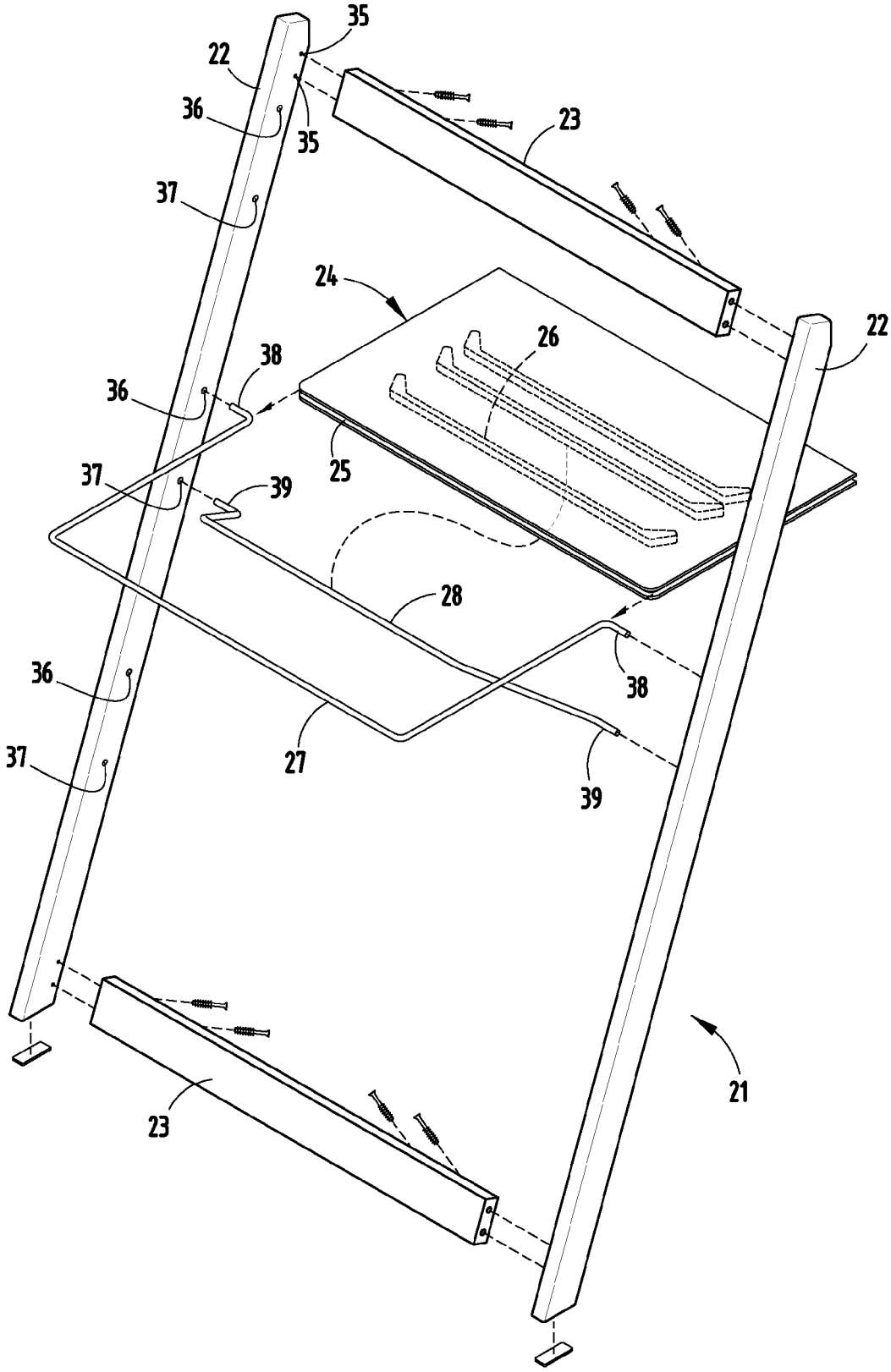
Figure 14:
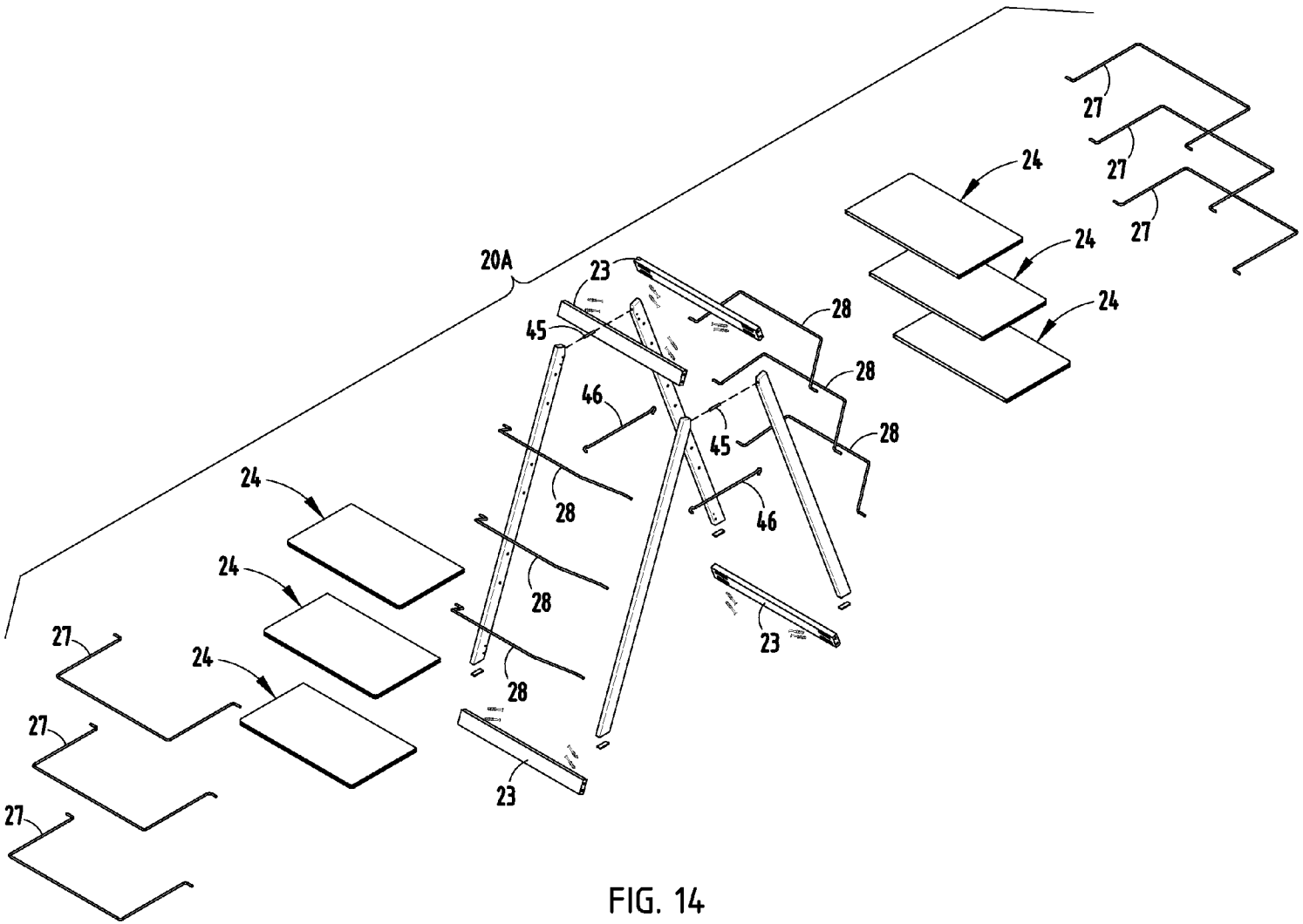
Figure 16:
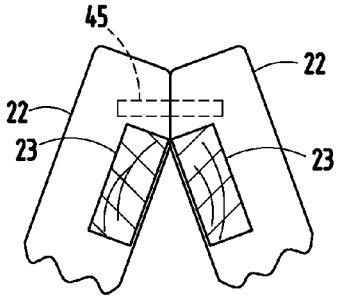
FIG. 16 is a fragmentary top section of the circled area in FIG. 15.

FIGS. 13-15 are perspective, exploded perspective, and side views of a second embodiment comprising a free-standing shelving system 20A, where opposing subassemblies as shown in FIGS. 1-2 are abutted together, connected at a top location by connector such as pegs (45) and connected at a second position by a tether link (46). In systems 20 and 20A, similar component and features are identified using similar numbers. FIG. 16 is a fragmentary top section of the circled area in FIG. 15 showing the peg 45 (dowel) extending into the abutting top sections of each frame member 22.

Figure 17:
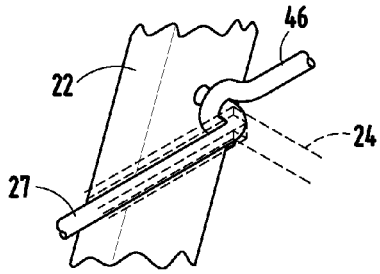
FIGS. 17 and 17A are enlarged fragmentary perspective and side views of one end of a double-hook connector (also called a tether link) from FIG. 15.
Figure 17A:
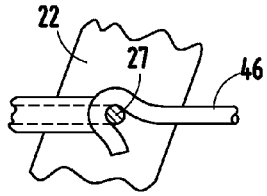
Figure 18:
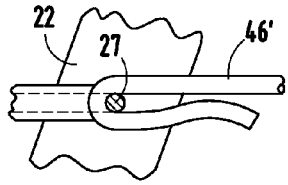
FIG. 18 is an alternative embodiment of the connector.

FIG. 17 is an enlarged fragmentary view of a tether link 46 with hooks that frictionally snap onto the ends of the supports 27 or 28. FIG. 18 is an alternative embodiment (link 46') of same but with larger hooks at each end. One of the illustrated tether links (46 or 46') is positioned on each side, between the associated frame members 22.

Figure 22:
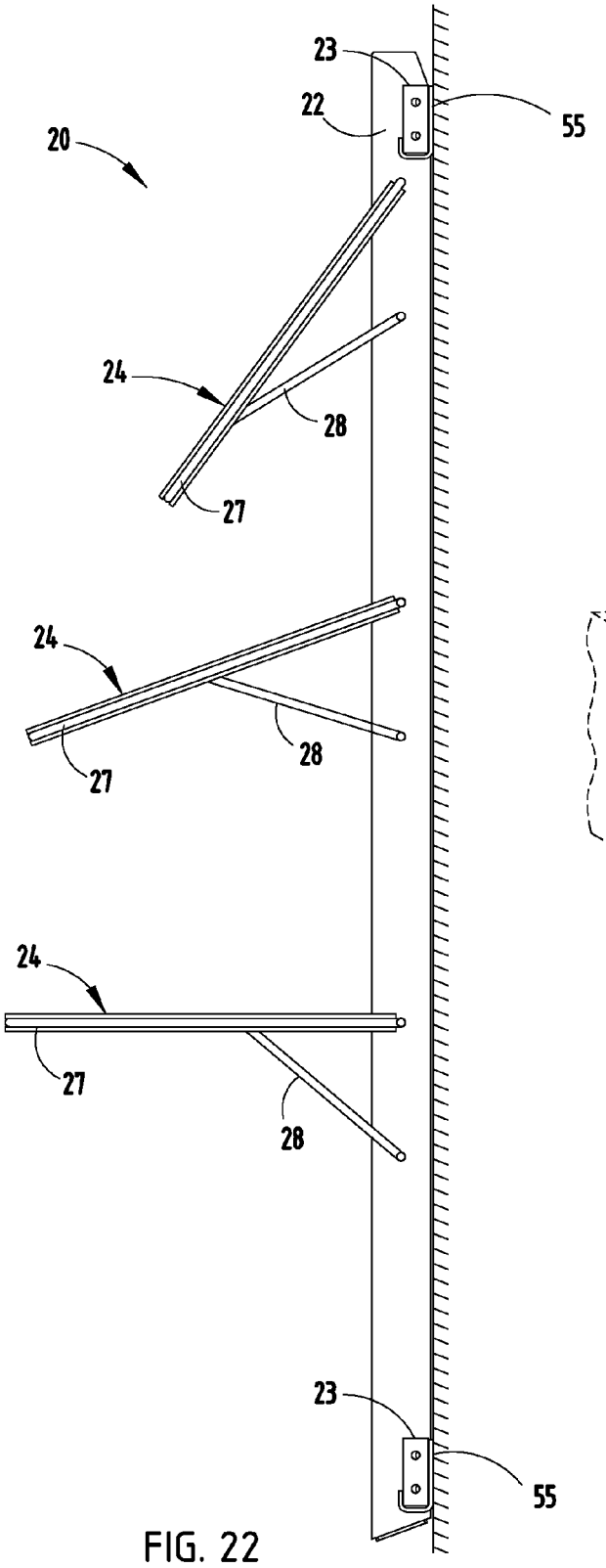
FIG. 22 is a side view of a wall-mounted shelf system including wall brackets.

FIG. 19 is a fragmentary side view of FIG. 15 (or FIG. 1A) showing three positions of a given shelf 24 (see also FIG. 22). As illustrated in FIG. 19, when the frame members 22 are angled at 20°, a first groove 26 receives the under-shelf support 28 for holding the shelf 24 in a horizontal position. When the frame members 22 are angled, a second groove 26A receives the under-shelf support 28 for holding the shelf 24 in a downwardly-angled orientation. When the frame members 22 are vertical (e.g. fastened flat against a wall), a third groove 26B receives the under-shelf support 28 for holding the shelf 24 horizontal.

Figure 20:
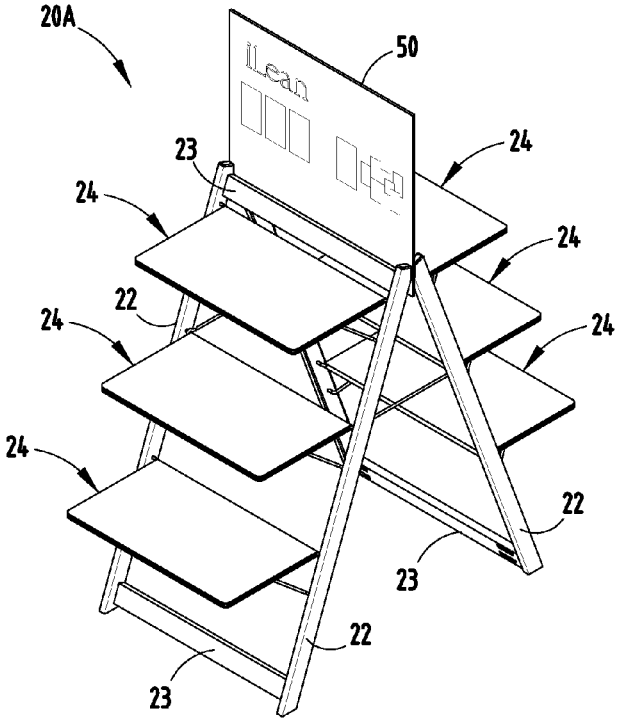
FIGS. 20-21 are perspective and fragmentary side views similar to FIGS. 15 and 16 but including a header panel.
Figure 21:
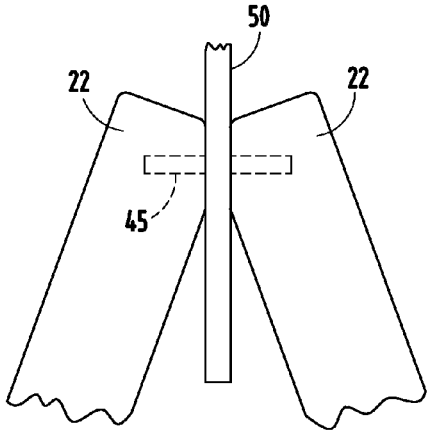

FIGS. 20-21 are perspective and fragmentary side views similar to FIG. 15 but including a header panel 50. It is contemplated that the header panel 50 can be made from a variety of different materials, and made with a variety of different shapes and sizes to serve various purposes and functions. As illustrated, the header panel 50 is a flat sheet of skinned foam or sheet-covered corrugated-inner material with printed information on its visible surfaces. The header panel 50 includes a pair of holes that align with the pegs 45 that extend between a top of the opposing frame members 22. When in position, the header panel 50 is held in a vertical position by the abutting (20 degree cut) surfaces of the two opposing frame members 22 and also by the pegs 45. Additional support can be provided by brackets, but it is not believed to be necessary in most applications. The header panel 50 can also be used on a wall-mounted system (see FIG. 24) or on a lean-against system (see FIG. 1A).

Notably, the illustrated header panel 50 (FIG. 20) can be replaced by headers having structure for supporting/providing a particular function, such as a header having a transparent pair of panels for receiving a photograph or advertising material therebetween, or a header having a chalk-board surface or white-board surface or black-board surface that can be erasably written on (such as by a restaurant advertising a dinner special), or can be a header having a screen-printed store logo and advertising material printed thereon.

Figure 23:
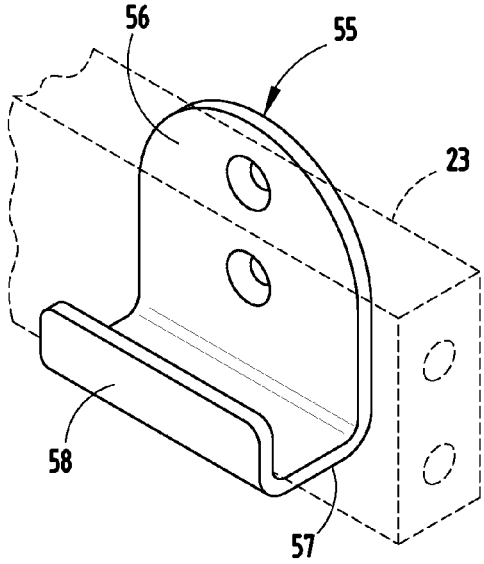
FIG. 23 is a perspective view of the wall bracket.
Figure 24:
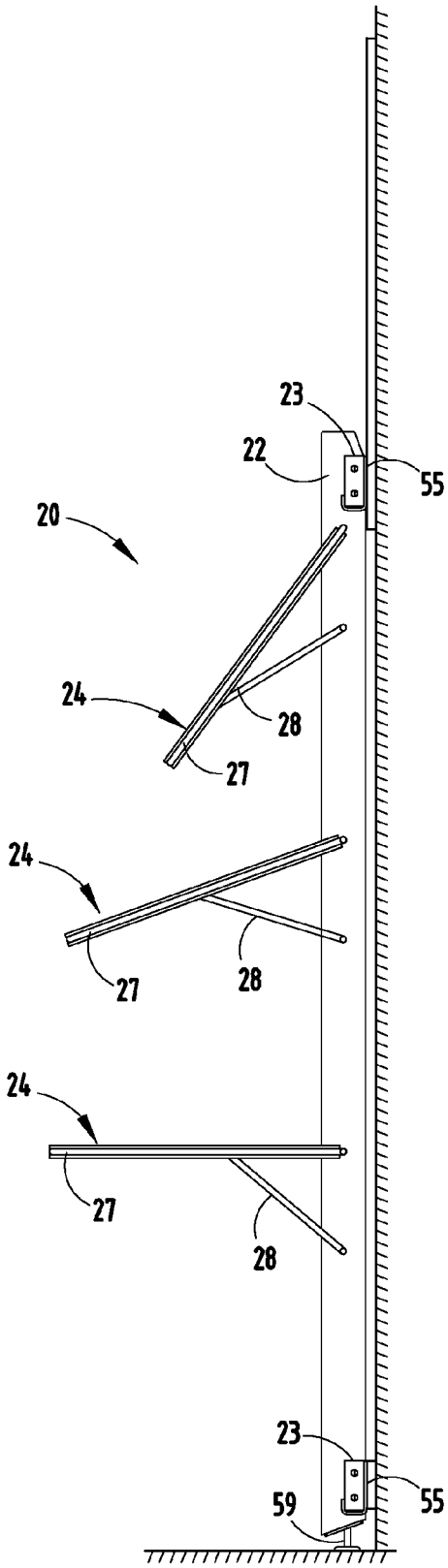
FIG. 24 is a view similar to FIG. 22 but incorporating a header panel.

FIG. 22 is a side view of a wall-mounted shelf system including wall brackets 55; and FIG. 23 is a perspective view of the wall bracket 55. The illustrated wall bracket 55 is J shaped, and includes a portion 56 with holes for receiving wall-engaging screws, a second portion 57 and a third portion 58 forming a channel for matably engaging a top one of the cross braces 23. A second set of wall brackets 55 can be used to secure the bottom cross brace 23 as well. It is noted that in some systems, only top wall brackets 55 are required (and bottom wall brackets are not required), such as when the top wall brackets are strong and well secured, and also when the system (and supported objects) have a sufficiently low weight. Alternatively, the frame members 22 can be secured by one (or two) top wall bracket 55 (FIG. 22) and by brackets 55 and/or rubber foot 59 (FIG. 24) placed on a bottom of the frame members 22. A header panel 50 can be designed with notches to slide downwardly over the top wall brackets 55 with a main portion of the header panel 50 extending above the system. As an aside, it is noted that the lean-to system (see FIG. 1A) can also be leaned against and tethered to non-wall structures, such as a tree, a fence, and other indoor and outdoor objects.

Figure 25:
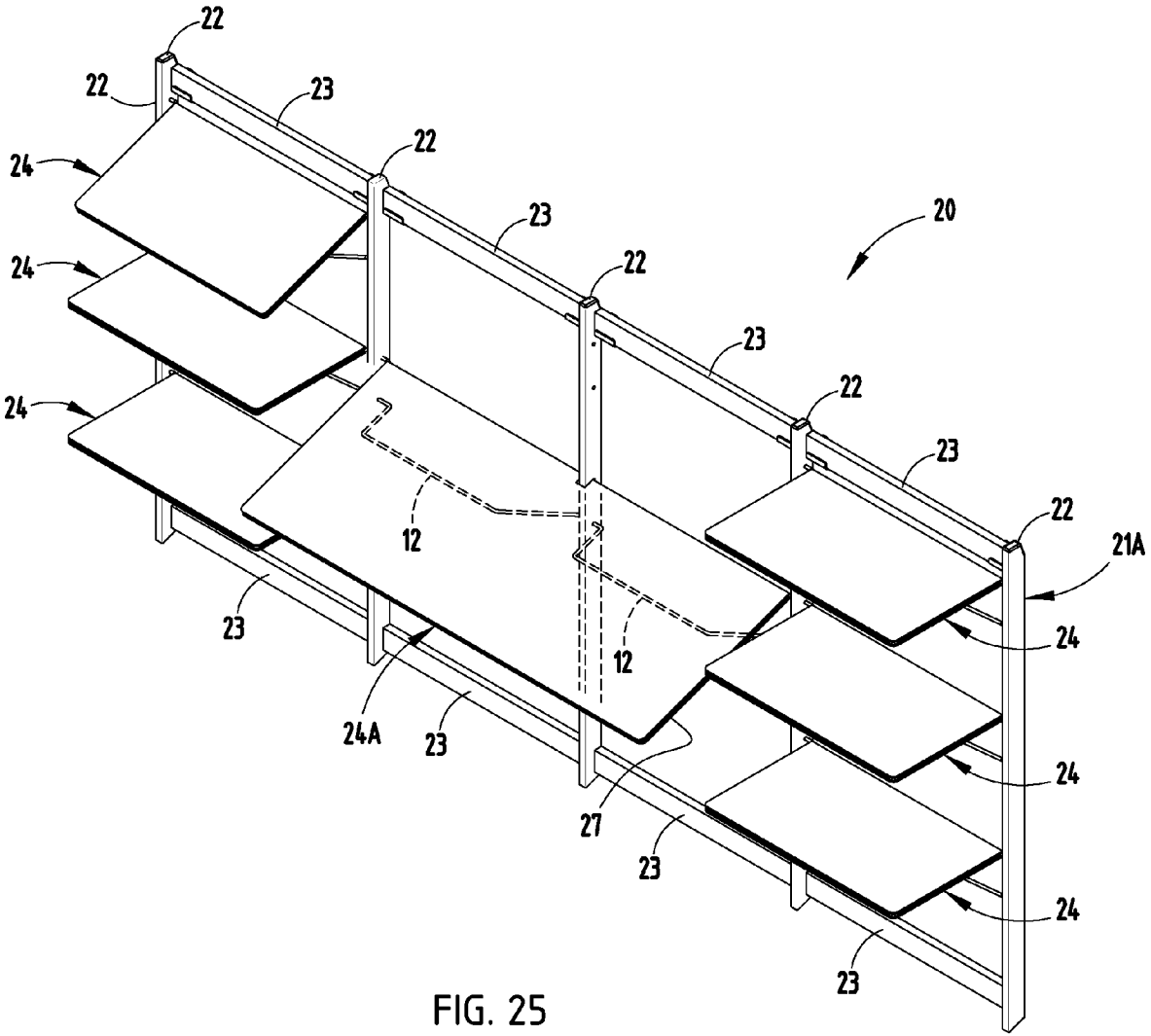
FIG. 25 is a perspective view of a modified shelving system including an enlarged wall-mounted frame.

FIG. 25 is a perspective view of a modified shelving system 20B including an enlarged wall-mounted frame 21A that replaces frame 21. The enlarged wall mounted frame 21A defines several frame members 22 (five illustrated), allowing shelves 24 to be adjustably positioned vertically and horizontally across its span. Notably, larger or smaller shelves can be positioned thereon, such as enlarged shelf 24A. The shelves 24 can be preassembled for compact storage and shipment. (See FIG. 28). Once in position in a building, the frame can be attached to a wall (or supported in a free standing position using back support), and the shelves 24 and 24A tipped outward to selected use positions (or rearranged and then tipped outward). This shelf system can be used to provide a desk (i.e. a larger shelf 24A) or a study area, an audio-visual area (i.e. with a television and/or stereo along with media/CD/DVD storage), an enlarged storage area (such as for storing plant, tools, clothes, etc). It is contemplated that utilities can be added to the shelf system, such as wires for electrical power and data communication.

Figure 27:
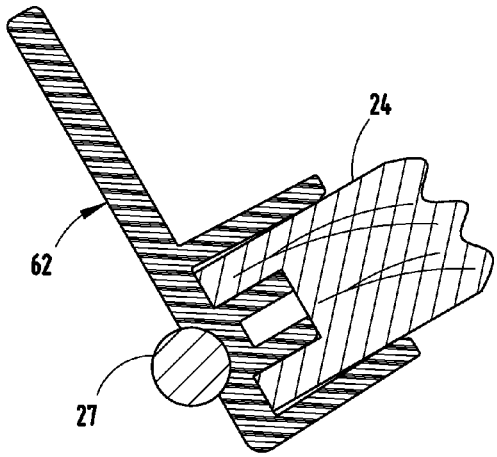
FIGS. 27 and 27A are cross sectional and perspective views of the shelf ledge in FIG. 26.
Figure 27A:
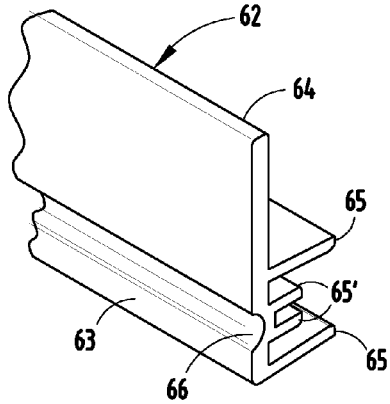

FIG. 26 is a side view of a lean-against-wall shelf system 20 including shelf ledges 62 attached to a front edge of the shelves 24; and FIG. 27 is a perspective view of the shelf ledge 62. The illustrated shelf ledge 62 includes a base 63 that forms a pocket shaped to matably engage a front edge of the shelf 24, and a lip flange 64 extends above the shelf's top surface. Thus, when the shelf 24 is held at an angled position, the lip flange 62 provides a stop to prevent materials (i.e. shoes, or books, or printed materials) from sliding off the angled shelf 24 (see FIGS. 26, 26A). The base 63 includes a front ridge or protrusion(s) 65 and 65' for matably engaging the front groove in the shelf 24, and also includes a rear round pocket 66 for matably receiving a section of wire of the bent-wire shelf support 27. Thus, the base 63, when nested between the shelf 24 and shelf support 27, provides stable engagement for itself and also stable secure support between the shelf 24 and the shelf support 27.

Figure 28:
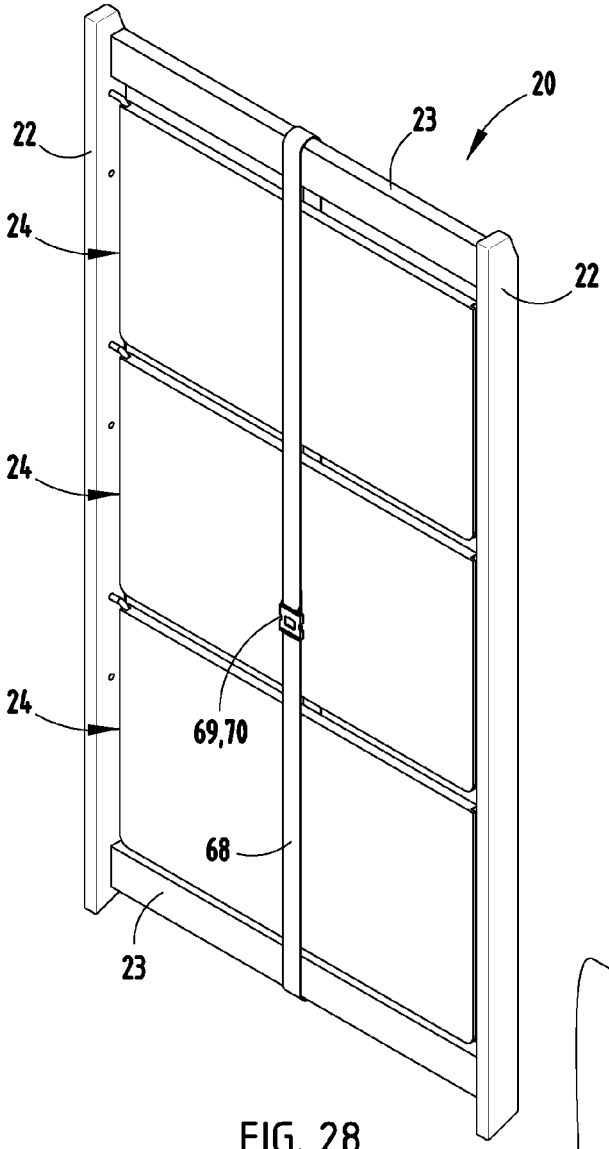
FIG. 28 is a perspective view of a preassembled shelf system in a collapsed position.
Figure 29:
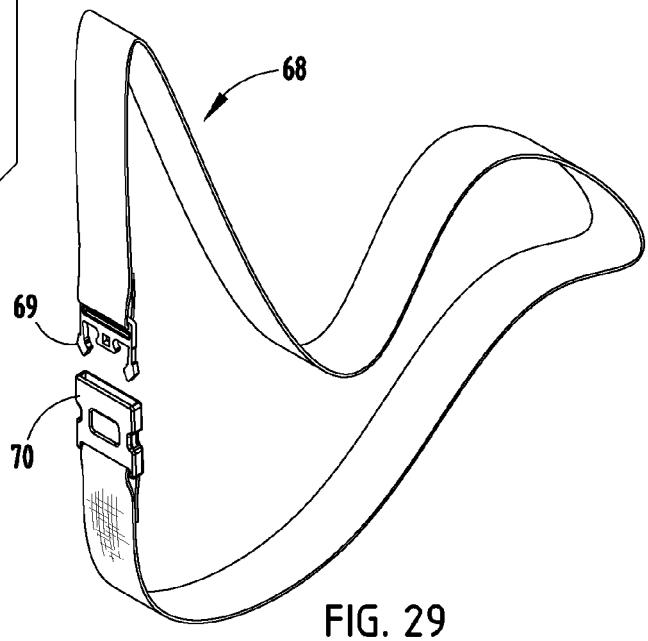
FIG. 29 is a view of a snap-connector belt strap for holding the shelf system in its collapsed position.

FIGS. 28-29 are front and side views of a preassembled shelf system in a collapsed position with all shelves 24 folded flat against the back frame 21. FIG. 30 is a view of the adjustable belt strap 68 from FIG. 28, the strap including releasable connectors 69, 70 (such as are often used in luggage) for holding the shelf system 20 in the collapsed position. As noted above, when the under-shelf supports 28 are removed, the shelves 24 can be folded to a position parallel the frame members 22, allowing the assembly 20 to be compactly stored and shipped and also used as a stablizing tether for use in windy conditions like on an outside deck.

It is contemplated that the components can be made in a large number of different shapes and sized and with a variety of different finishes, and further that a variety of different materials can be used to make the components of the present shelving system, including wood, metal, plastic, composite, and various combinations of same. For example, using the shelf 24 as an example, it can be made of wood or wood composite. Also, the shelf can be made of multiple layers adhered (or fastened) together to form the perimeter groove (25), instead of a machined groove. The shelf can be given a four or three or two-sided perimeter lip, the shelf can include top-facing recesses to retain items therein. It can be given a single full-width front upright raised lip and used on an angled shelf, such as to support books or magazines. The shelf can include electrical connectors and wiring for a light or stereo or TV. It can be made of glass or transparent plastic (or given a window) for see-through capability and/or include an under-shelf retainer or holder, such as for holding a picture against a bottom of the shelf for viewing from above the shelf. It can be made of a wire matrix or multi-slat and/or can include holes/apertures for pass-through of water and moisture or for allowing vine plants to grow through and around it. The shelf can also include a top-facing recess for a glass or wine bottle, and/or a top clip for holding an article on the shelf. Also, the shelf can include or support baskets, trays, drawers, aromatic woods, jewelry storage, personal lockable safes, a light, electrical utilities, and/or be adapted as desired for particular uses and preferences.

Advantageously, the present system is a surprisingly stable system or "platform" that can be leaned against virtually any structure, including a wall, deck rails, trees, tailgates, boat hull, outside or inside structure, or it can be made free-standing. Also, frictional feet can be added to increase stable engagement with a floor surface, and/or also adjustable feet can be added to a bottom of the legs to allow the shelving system to be adjusted to a vertical position even when the floor or ground support is uneven. It is conceived that the present system and components can even be given sufficient strength and stability to form a short step ladder if desired.

The header panel is considered to be particularly useful for point of purchase displays, such as in retail stores and distribution sites, since it provides an attractive but functional topper to the system. In one form, the header panel is primarily a place for store logo and advertising materials, while in other forms it serves a more functional purpose, such as providing instructions or place for pictures or providing an erasable surface to write on.

To summarize, the present shelving system combines a frame with a plurality of shelves having multi-sided perimeter grooves and undercut grooves, and provides wire-rod perimeter shelf supports and wire-rod angled under-shelf supports that selectively support the shelves on the frame. Advantageously, the shelving system is intuitive to assemble, and does not require tools or separate fasteners for assembly. Nonetheless, assembly is quick, easy, and stable. At the same time, the system allows substantial adjustability, selectivity, flexibility and individuality. Further, by purchasing different frames and shelves, a wide variety of very different shelving systems can be constructed for very different functional and aesthetic needs. Also, the shelves are angularly adjustable, height adjustable, and easily replaceable, yet very secure and stable.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A shelving system comprising:

at least two spaced frame members;

a shelf positioned between the frame members and defining opposing side grooves extending fore-aft of the shelf and a front groove;

a shelf support slidably engaging the side grooves in a first direction parallel the side grooves for assembly and including a front section engaging the front groove and further including end sections engaging the frame members in a second direction not parallel the first direction, the end sections being held in engagement by a width of the shelf; and an under-shelf support adapted to support the shelf in a use position.

2. The shelving system defined in claim 1, wherein the frame members, the shelf, the shelf support, and the under-shelf support engage without the use of separate fasteners.

3. The shelving system defined in claim 1, wherein at least one of the shelf support and the under-shelf support include a U-shaped bent wire.

4. The shelving system defined in claim 1, including a header panel attached to a top of the frame members.

5. The shelving system defined in claim 1, wherein the under-shelf support and shelf are configured to support the shelf at different shelf angles.

6. The shelving system defined in claim 1, including a wall bracket supporting a subassembly including the frame members vertically on a supporting wall.

7. The shelving system defined in claim 1, wherein, upon removing the under-shelf support, the shelf folds parallel to the frame members for storage and shipment.

8. The shelving system defined in claim 1, wherein the shelf includes a front groove forming with the side grooves a perimeter groove that extends along front and side edges of the shelf.

9. The shelving system defined in claim 1, wherein the shelf support comprises a bent wire.

10. The shelving system defined in claim 1, wherein the shelf support includes linear sections arranged to slip onto the side grooves on the at least one shelf from a rear side of the shelf.

11. The shelving system defined in claim 1, wherein the under-shelf support includes a bent wire.

12. The shelving system defined in claim 1, including a plurality of additional shelves, additional shelf supports, and additional under-shelf supports identical to the first-mentioned shelf, shelf support and under-shelf support.

13. The shelving system defined in claim 1, wherein the shelf includes at least one of a continuous perimeter lip, a top-facing recess for holding an item on the shelf, a see-through portion with bottom holder for picture, and a top clip for holding an article on the shelf.

14. A shelving system comprising:

at least two spaced frame members;

a shelf positioned between the frame members and defining opposing side grooves extending fore-aft of the shelf;

a shelf support slidably engaging the side grooves in a first direction parallel the side grooves for assembly and including end sections engaging the frame members in a second direction not parallel the first direction, the end sections being held in engagement by a width of the shelf; and an under-shelf support adapted to support the shelf in a use position;

wherein the at least two frame members include a first pair of spaced-apart frame members positioned abutting against a second pair of spaced-apart frame members to define a free-standing tripod-shaped arrangement, with a top of the first and second pair secured together.

15. The shelving system defined in claim 14, including at least one fastener attaching a top of the first and second pair of frame members together.

16. The shelving system defined in claim 14, including a header positioned between the first and second pair of frame members.

17. A shelving system comprising:

at least two spaced frame members;

a shelf positioned between the frame members and defining opposing side grooves extending fore-aft of the shelf;

a shelf support slidably engaging the side grooves in a first direction parallel the side grooves for assembly and including end sections engaging the frame members in a second direction not parallel the first direction, the end sections being held in engagement by a width of the shelf;

an under-shelf support adapted to support the shelf in a use position; and including a shelf ledge engaging a front of the shelf and located between the front of the shelf and a front section of the shelf support.

18. A shelving system comprising:

at least two spaced frame members;

a shelf positioned between the frame members and defining opposing side grooves extending fore-aft of the shelf;

a shelf support slidably engaging the side grooves in a first direction parallel the side grooves for assembly and including end sections engaging the frame members in a second direction not parallel the first direction, the end sections being held in engagement by a width of the shelf; and an under-shelf support adapted to support the shelf in a use position;

wherein a bottom of the shelf includes at least three slots for engaging the under-shelf support to hold the shelf at different selected angles.

19. A shelving system comprising:

at least two spaced frame members;

a shelf positioned between the frame members and defining opposing side grooves extending fore-aft of the shelf;

a shelf support slidably engaging the side grooves in a first direction parallel the side grooves for assembly and including end sections engaging the frame members in a second direction not parallel the first direction, the end sections being held in engagement by a width of the shelf; and an under-shelf support adapted to support the shelf in a use position;

wherein the shelf includes a recess, the under-shelf support being configured and shaped to engage the recess and stably support the shelf without separate fasteners.

20. A shelving system comprising:

at least two spaced frame members;

a shelf positioned between the frame members and defining opposing side grooves extending fore-aft of the shelf;

a shelf support slidably engaging the side grooves in a first direction parallel the side grooves for assembly and including end sections engaging the frame members in a second direction not parallel the first direction, the end sections being held in engagement by a width of the shelf; and an under-shelf support adapted to support the shelf in a use position;

wherein the shelf includes a bottom latch for retaining the under-shelf support to the shelf.

21. A shelving system comprising:

at least two spaced frame members;

a shelf positioned between the frame members and defining opposing side grooves extending fore-aft of the shelf;

a bent-wire shelf support with wire sections having a width matching a width dimension of the side grooves and slidably engaging the side grooves in a first direction parallel the side grooves for assembly and including end sections engaging the frame members in a second direction not parallel the first direction, the end sections being held in engagement by a width of the shelf; and an under-shelf support adapted to support the shelf in a use position.

22. A shelving system comprising:

at least two spaced frame members;

a shelf consisting of a flat planar panel with top and bottom surfaces and that is positioned between the frame members and defining opposing side grooves extending fore-aft of the shelf;

a shelf support slidably engaging the side grooves in a first direction parallel the side grooves for assembly and including end sections engaging the frame members in a second direction not parallel the first direction, the end sections being held in engagement by a width of the shelf; and an under-shelf support engaging the bottom surface and adapted to support the shelf in a use position.

* * * * *